US010762805B1

(12) United States Patent
Zhou

(10) Patent No.: US 10,762,805 B1
(45) Date of Patent: Sep. 1, 2020

(54) SIMULATED SOLID FUEL

(71) Applicant: NINGBO RICHEN ELECTRICAL APPLIANCE CO., LTD, Ningbo (CN)

(72) Inventor: Yin Zhou, Ningbo (CN)

(73) Assignee: NINGBO RICHEN ELECTRICAL APPLIANCE CO., LTD, Ningbo (CN)

( * ) Notice: Subject to any disclaimer, the term of this patent is extended or adjusted under 35 U.S.C. 154(b) by 0 days.

(21) Appl. No.: 16/585,189

(22) Filed: Sep. 27, 2019

(30) Foreign Application Priority Data

Apr. 26, 2019 (CN) ..... 2019 1 0344144
Apr. 26, 2019 (CN) ..... 2019 2 0585592 U

(51) Int. Cl.
*F24B 1/18* (2006.01)
*G09F 13/00* (2006.01)
*F24C 7/00* (2006.01)

(52) U.S. Cl.
CPC ..... *G09F 13/00* (2013.01); *F24B 1/1808* (2013.01); *F24C 7/004* (2013.01)

(58) Field of Classification Search
None
See application file for complete search history.

(56) References Cited

U.S. PATENT DOCUMENTS 9,709,282 B1 * 7/2017 Fomenko ..... F21S 10/002
2006/0275721 A1 * 12/2006 Starr ..... G09F 19/12 431/125
2010/0031543 A1 * 2/2010 Rice ..... F24C 7/004 40/428
2014/0355970 A1 * 12/2014 Zhao ..... F24F 6/14 392/403
2015/0068079 A1 * 3/2015 O'Neill ..... F24B 1/1808 40/428
2017/0307223 A1 * 10/2017 Li ..... F24C 7/004
2019/0353316 A1 * 11/2019 Belverge ..... F21S 10/04

* cited by examiner

*Primary Examiner* — Kristina N Junge
(74) *Attorney, Agent, or Firm* — Charles C. Achkar; Ostrolenk Faber LLP.

(57) ABSTRACT

The present invention discloses a simulated solid fuel, including a fuel body, a flow guiding device, a mist source and a light source. The fuel body houses a mist distribution chamber and an air directing chamber which are isolated from each other, and the surface of the fuel body includes mist outlets and mist inlets, the mist outlets and the mist inlets all communicating with the mist distribution chamber. The flow guiding device provides an upwardly rising air flow in the air directing chamber. The mist source delivers mist to the mist distribution chamber through the mist inlets, and is then attracted by the air flow injected from the air ejection port to move toward the middle area of the fuel body to form a flame shape, and is irradiated by the light emitted from the light source, thereby truly simulating the realistic effect of solid fuel combustion.

7 Claims, 7 Drawing Sheets

SIMULATED SOLID FUEL

CROSS REFERENCE TO RELATED APPLICATIONS

The present application claims priority to China Application No. 201910344144.1 filed on Apr. 26, 2019 and China Application No. 201920585592.6 filed Apr. 26, 2019, the subject matter of each of which are incorporated herein by reference in their entirety.

TECHNICAL FIELD

The present invention relates to a simulated solid fuel, and in particular to a simulated solid fuel on an electric fireplace for simulating combustion of a real solid fuel.

BACKGROUND ART

At present, the structure of the electric fireplace flame simulating device is mostly composed of a simulated fuel bed that acts as a combustion medium during combustion and a simulated flame device that simulates the flame generated during combustion.

The simulated fuel bed is typically composed of a simulated solid fuel, an ash bed, and a light source located below the ash bed. The simulated solid fuel simulation method generally uses light to project on the body of the simulated solid fuel, and the light makes it transparent, similar to the state in which the real solid fuel is burning red. Other devices simulate the state of real burning fuel by arranging light bars inside or around the simulated solid fuel to emit light.

However, in the existing technology, although it can simulate the burning red state of the real solid fuel and can even emit light, there is no flame shape above and around the simulated solid fuel, and it does feel like real burning flame that is flickering and leaping in air.

SUMMARY

The technical problem to be solved by the present invention is to provide a simulated solid fuel. When used for an electric fireplace, the present invention can more realistically simulate the effect of solid fuel combustion such that not only the fuel itself is burning red through, but also the flame is fluttering from the two sides and leaping above the simulated solid fuel, gleaming and dancing like a spirit. The present invention has a simple structure and a convenient production and manufacturing process and is suitable for simulating the combustion of simulated solid fuel in most electric fireplaces.

The technical solution adopted by the present invention to solve the above technical problem is: a simulated solid fuel includes a fuel body, a flow guiding device, a mist source and a light source. The fuel body is a hollow structure and is provided with a mist distribution chamber and an air directing chamber. The mist distribution chamber and the air directing chamber are isolated from each other inside the fuel body, and mist outlets are disposed on a peripheral surface of the fuel body. The mist outlets can be disposed on one side, two sides, three sides, four sides or all the surface of the fuel body, and the mist outlets communicate with the mist distribution chamber. The fuel body is further provided with mist inlets, and the mist inlets communicate with the mist distribution chamber. The mist source is a device capable of generating mist, such as a device generating mist by an ultrasonic atomizing device, and is disposed at a suitable position. The mist source is provided with a mist delivery pipe, and the mist source is connected to the mist inlets through the mist delivery pipe. An air ejection port is provided in the top surface of the fuel body, and the air ejection port communicates with the air directing chamber.

The flow guiding device can guide the air in the air directing chamber to rise upwardly and then be ejected from the air ejection port. The mist generated by the mist source enters the mist distribution chamber through the mist delivery pipe, and then emerges from the mist outlets. Since air is ejected from the air ejection port, the air velocity in the middle region of the upper surface of the fuel body is higher and the air pressure is lowered, which will cause the mist emerging from the mist outlets to have a tendency to move toward the middle region of the upper surface of the fuel body, i.e., to move along and rise upward from the upper surface of the fuel body.

The light source may be disposed on a surface and/or both sides and/or inside of the fuel body, and light emitted from the light source is irradiated on the mist emerging from the mist outlets. The puffs of mist create various upward moving shapes to simulate the state of flame combustion.

Further, in order to enable the mist to smoothly vent from the mist outlets, the pressure of the mist entering the mist distribution chamber through the mist delivery pipe is higher than the atmospheric pressure to give the mist the power to move forward by using, for example, an air blowing device disposed in the mist generator to blow the mist into the mist distribution chamber.

Further, the flow guiding device is a heat source disposed inside or at the bottom of the air directing chamber, and the heat source heats the air in the air directing chamber, causing the air in the air directing chamber to move upward.

Further, the flow guiding device is an air blowing device disposed inside or at the bottom of the air directing chamber, and the air in the air directing chamber is blown upward by the air blowing device.

Further, in order to enable the light emitted from the light source to better radiate the mist emerging from the mist outlets, the light source has a bar shape and is disposed on both sides of the fuel body, and the light emitted from the light source aims, at an angle, at the space above the mist outlets and the fuel body.

Compared with the prior art, the present invention has these advantages: a variety of flickering flame-like shapes are formed on both sides and the upper surface of the simulated solid fuel by using the mist, and the light is irradiated on the mist to form a shape that simulates the combustion of a real flame, and the simulated solid fuel has a simple structure and convenient production process and is suitable for use as a simulation device in most electric fireplaces.

Figure 1:
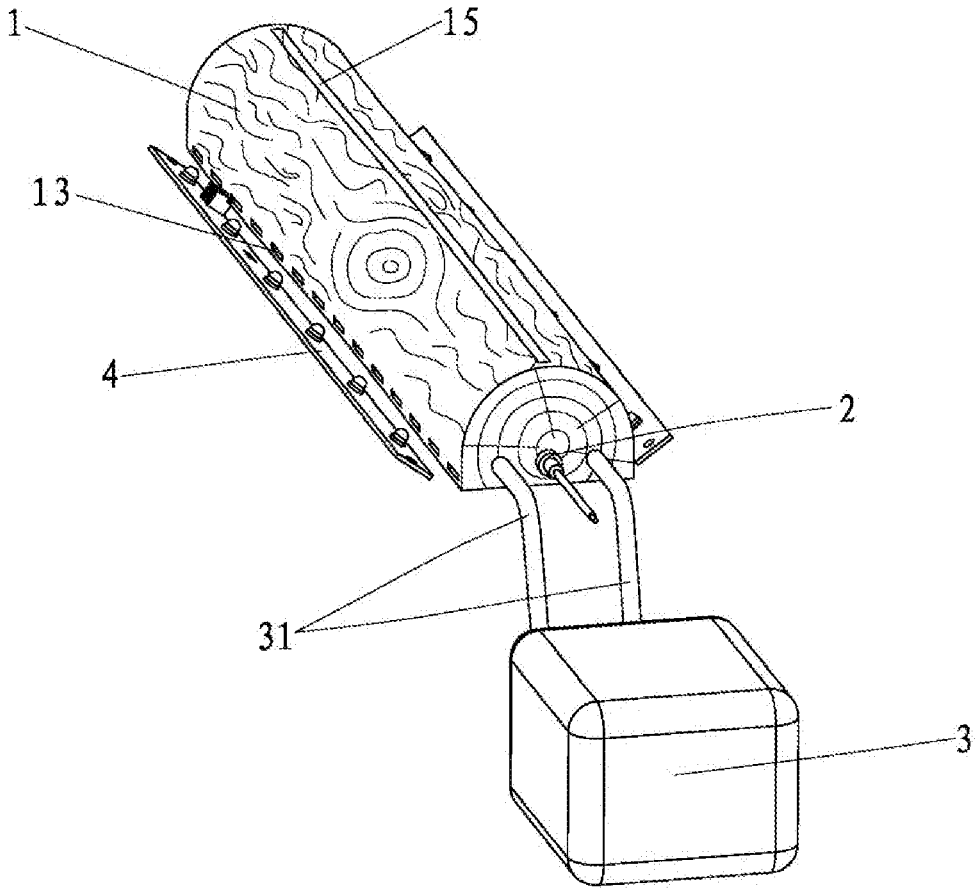
FIG. 1 is a three-dimensional schematic view showing the overall structure of Embodiment 1 of the present invention.
Figure 2:
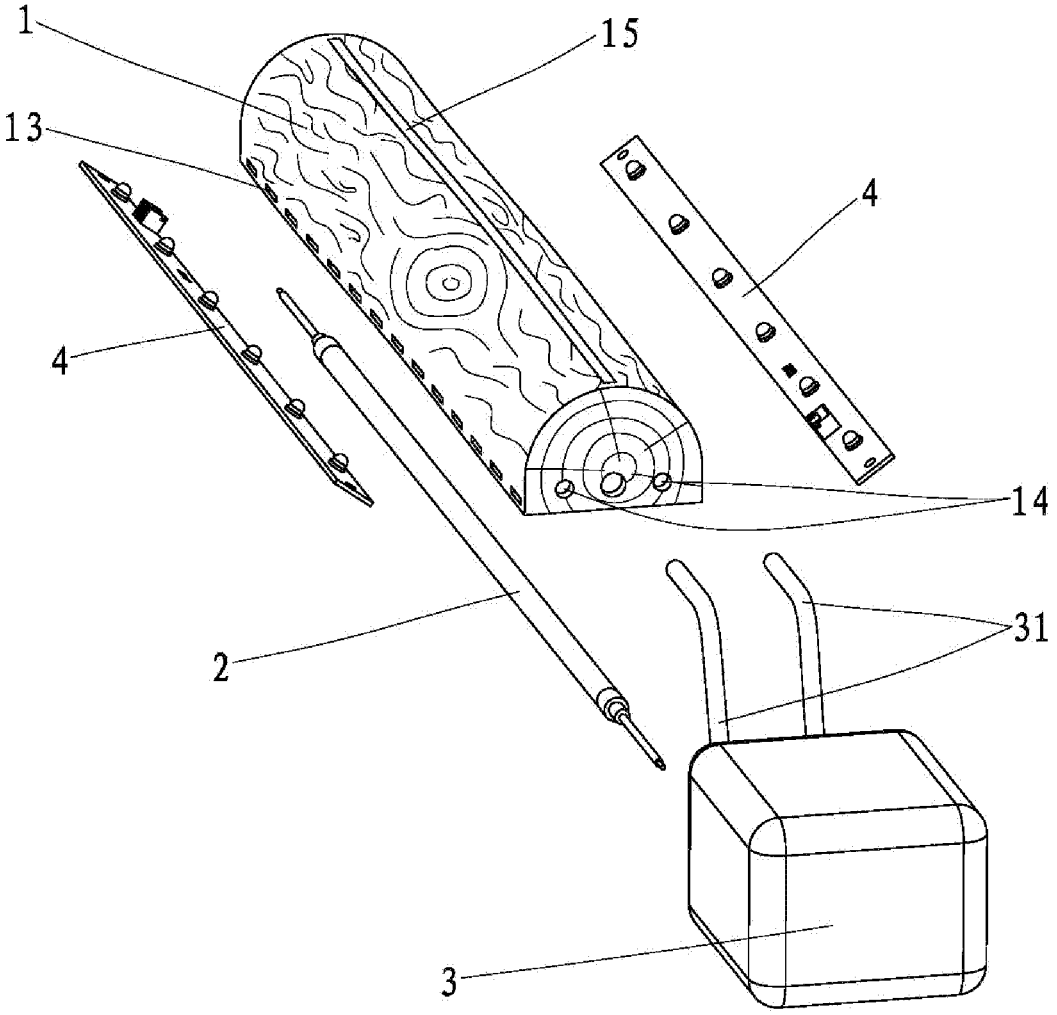
FIG. 2 is a three-dimensional exploded schematic view of Embodiment 1 of the present invention.
Figure 3:
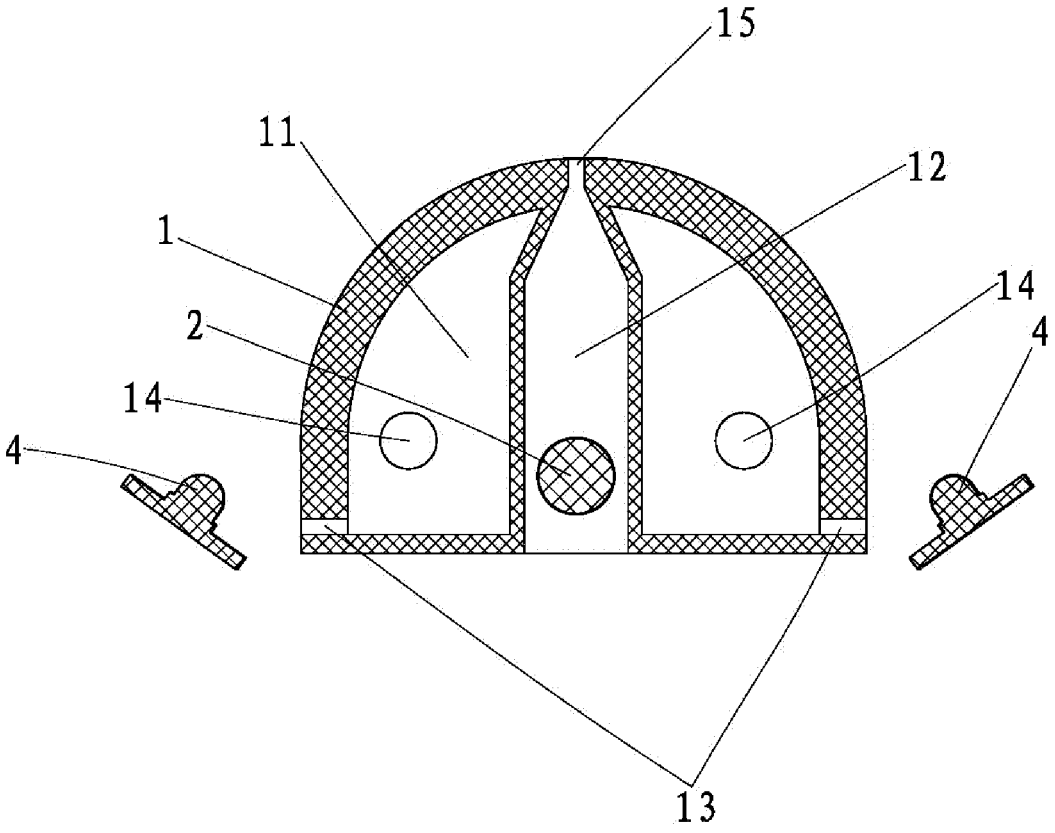
FIG. 3 is a half cross-sectional structural schematic view of Embodiment 1 of the present invention.
Figure 4:
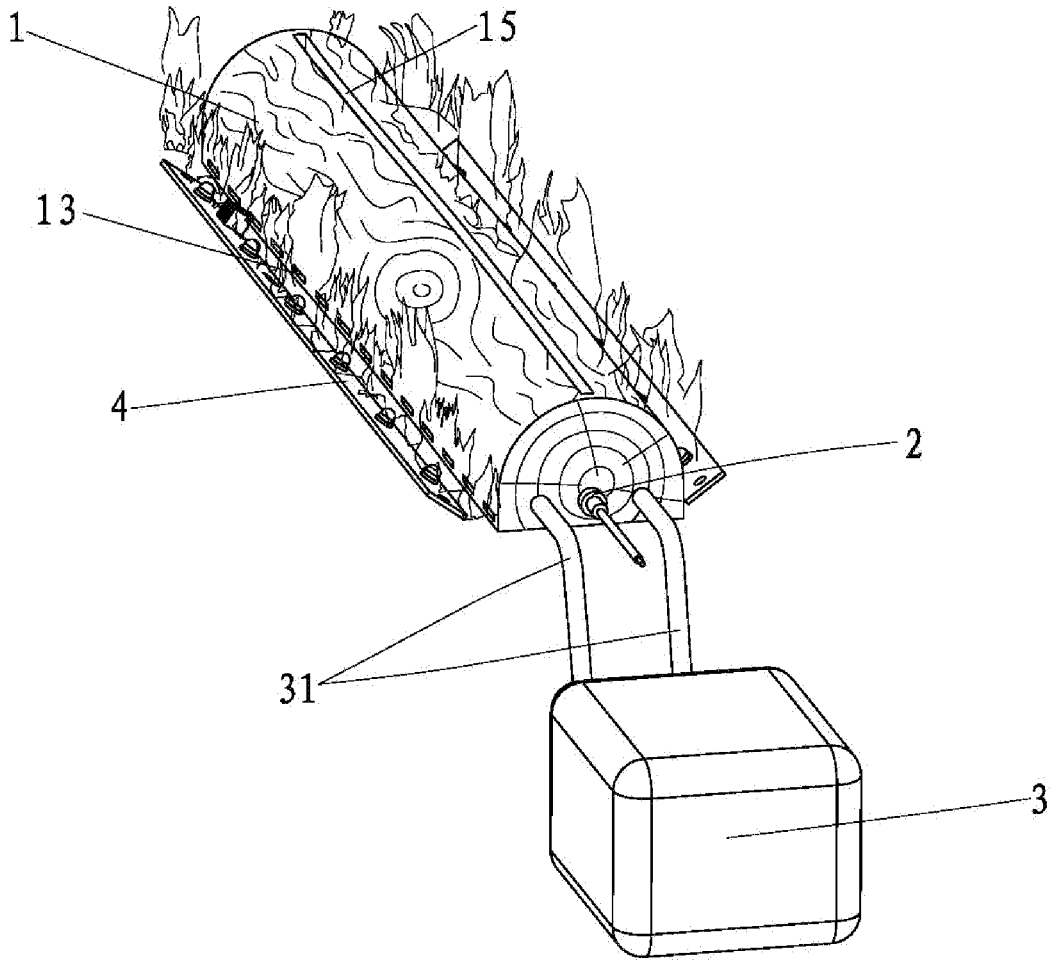
FIG. 4 is a schematic view showing the working state of the simulated flame combustion according to Embodiment 1 of the present invention.

The names of the components in the figures are: 1—fuel body; 2—flow guiding device; 3—mist source; 4—light source; 11—mist distribution chamber; 12—air directing chamber; 13—mist outlet; 14—mist inlet; 15—air ejection port; 21—fan; 31—mist delivery pipe.

DETAILED DESCRIPTION

The present invention will be further described in detail below with reference to the embodiments of the drawings.

Embodiment 1

As shown in FIG. 1 to FIG. 4, a simulated solid fuel includes a fuel body 1, a flow guiding device 2, a mist source 3 and a light source 4. The fuel body 1 has a hollow structure and is provided with a mist distribution chamber 11 and an air directing chamber 12. The mist distribution chamber 11 and the air directing chamber 12 do not communicate with each other inside the fuel body 1, and mist outlets 13 are disposed on the periphery of the edge of the fuel body 1. In Embodiment 1, the mist outlets 13 are disposed on both sides of the fuel body 1. The fuel body 1 is provided with mist inlets 14, and the mist inlets 14 communicate with the mist distribution chamber 11 and are connected to a mist delivery pipe 31 on the mist source 3. In Embodiment 1, the mist source 3 is an atomizing ultrasonic mist generator. The fuel body 1 is further provided with an air ejection port 15, and the air ejection port 15 communicates with the air directing chamber 12. In Embodiment 1, the flow guiding device 2 is a heat source in the form of an electric heating tube, which is disposed inside the air directing chamber 12. Due to the heating of the electric heating tube, the air in the air directing chamber 12 is heated to form a rising air flow. In Embodiment 1, the light source 4 is two LED light panels disposed on both sides of the fuel body 1, and the light emitted from the light source 4 is irradiated obliquely and upward toward the fuel body 1.

During operation, mist is generated inside the mist source 3, and the mist is delivered into the mist distribution chamber 11 through the mist delivery pipe 31 by a power device inside the mist source 3. When the amount of mist in the mist distribution chamber 11 reaches a certain level, the mist will vent from the mist outlets 13. The flow guiding device 2 is started simultaneously or subsequently or in advance, and the flow guiding device 2, that is, the electric heating tube starts to heat the air in the air directing chamber 12. Since the air expands after being heated, it is ejected from the air ejection port 15, thereby forming an air flow in the middle area of the upper surface of the fuel body 1. According to aerodynamics, the faster the gas velocity, the lower the pressure, so the pressure in the middle area of the upper surface of the fuel body 1 is lowered. This will cause the mist venting from the mist outlets 13 to have a tendency to move toward the middle area of the upper surface of the fuel body 1, i.e., moving along and rise upwardly from the upper surface of the fuel body 1. The light emitted from the light source 4 is irradiated on the mist venting from the mist outlets 13, and the puffs of mist create various upward flame-like shapes to simulate the state of real solid fuel flame combustion.

Embodiment 2

Figure 5:
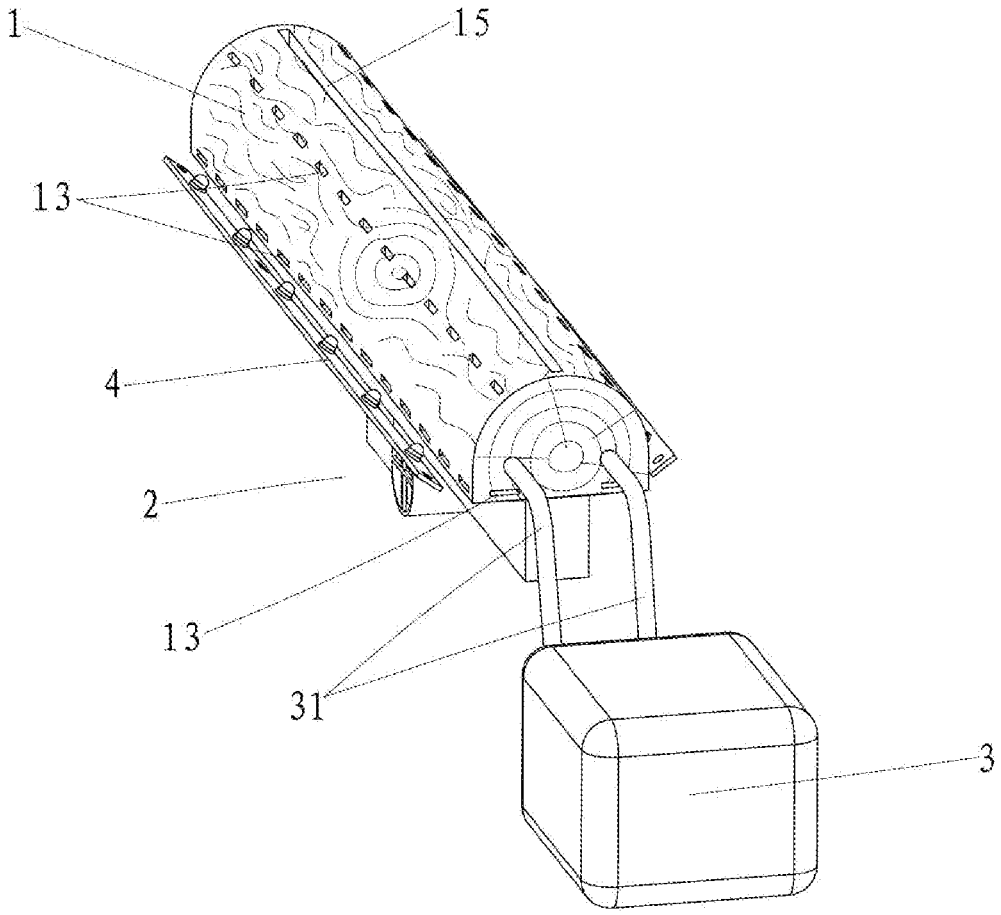
FIG. 5 is a three-dimensional schematic view showing the overall structure of Embodiment 2 of the present invention.
Figure 6:
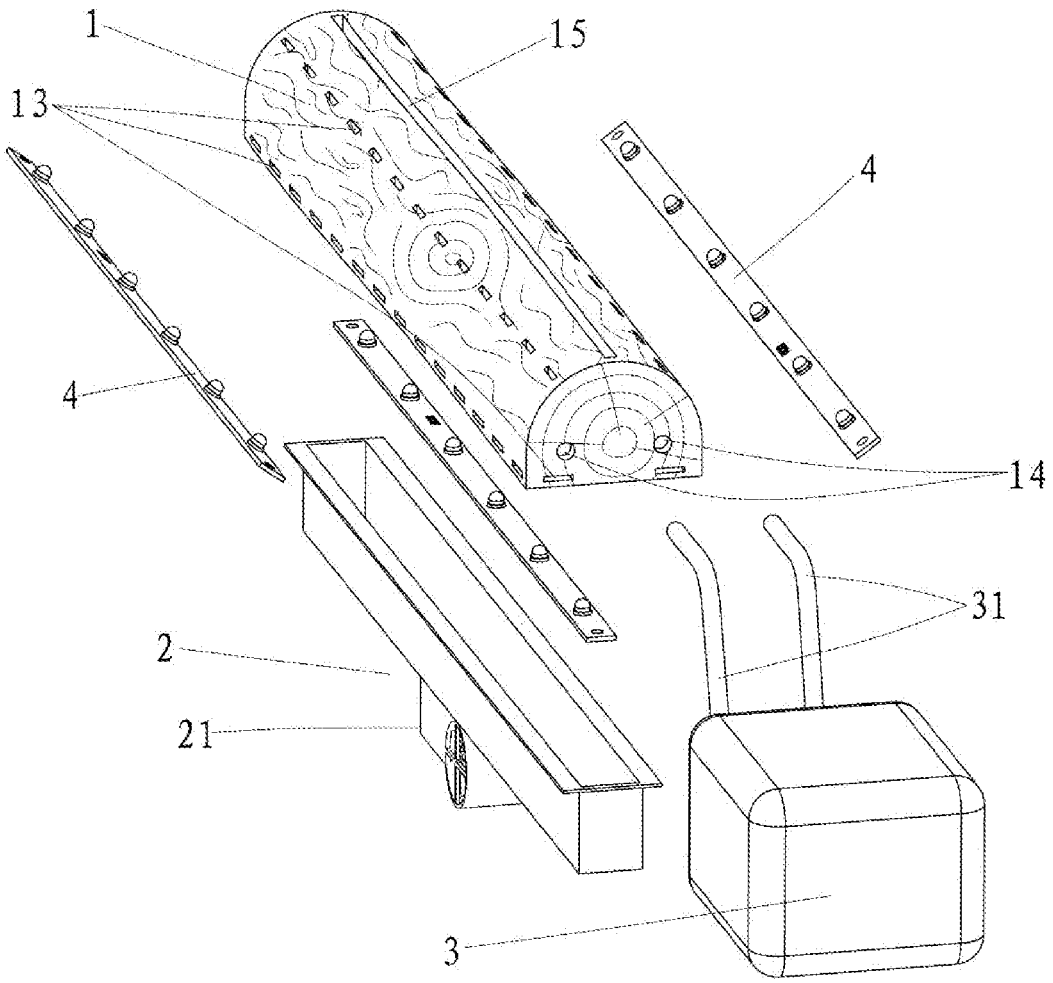
FIG. 6 is a three-dimensional exploded schematic view of Embodiment 2 of the present invention.
Figure 7:
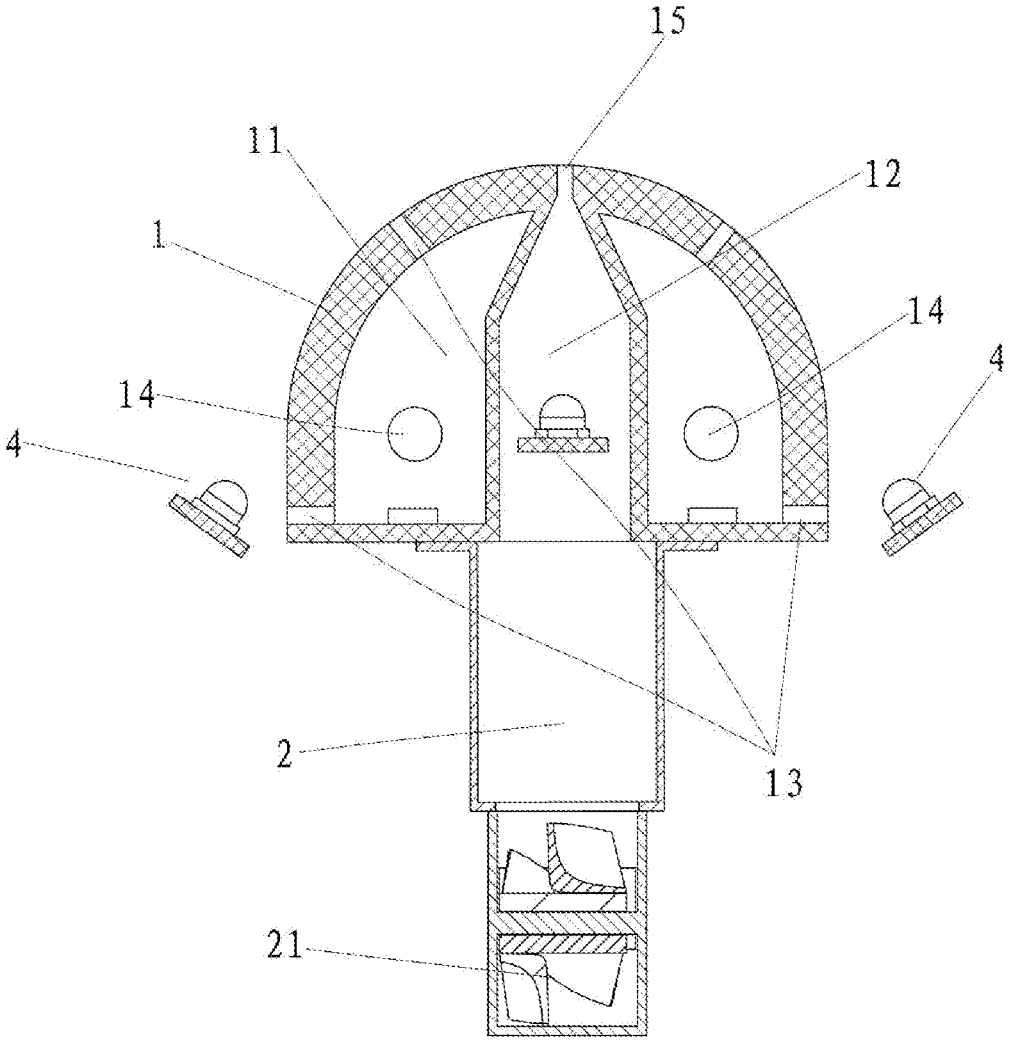
FIG. 7 is a schematic view of a half cross-sectional structure of Embodiment 1 of the present invention.

As shown in FIG. 5 to FIG. 7, a simulated solid fuel includes a fuel body 1, a flow guiding device 2, a mist source 3 and a light source 4. The fuel body 1 has a hollow structure and is provided with a mist distribution chamber 11 and an air directing chamber 12. The mist distribution chamber 11 and the air directing chamber 12 do not communicate with each other inside the fuel body 1, and mist outlets 13 are disposed on the periphery of the edge of the fuel body 1. In Embodiment 2, the mist outlets 13 are disposed on four side edges and the upper surface region of the fuel body 1. The fuel body 1 is provided with mist inlets 14, and the mist inlets 14 communicate with the mist distribution chamber 11 and are connected to a mist delivery pipe 31 on the mist source 3. In Embodiment 2, the mist source 3 is an atomizing ultrasonic mist generator. The fuel body 1 is further provided with an air ejection port 15, and the air ejection port 15 communicates with the air directing chamber 12. In Embodiment 2, the flow guiding device 2 is an air duct powered by a fan 21, which is disposed at the bottom of the air directing chamber 12, and the flow guiding device 2 provides an upwardly rising air flow in the air directing chamber 12. In Embodiment 2, the light source 4 is three LED light panels respectively disposed on the two sides of the fuel body 1 and inside the fuel body 1, and the light emitted from the light source 4 is irradiated obliquely upward and/or upward toward the upper surface of the fuel body 1.

During operation, mist is generated inside the mist source 3, and the mist is delivered into the mist distribution chamber 11 through the mist delivery pipe 31 by a power device inside the mist source 3. When the amount of mist in the mist distribution chamber 11 reaches a certain level, the mist will vent from the mist outlets 13. The flow guiding device 2 is started simultaneously or subsequently or in advance, and under the action of the fan 21, the air in the air directing chamber 12 moves upward and is then ejected from the air ejection port 15, thereby forming an air flow in the middle area of the upper surface of the fuel body 1. According to aerodynamics, the faster the gas velocity, the lower the pressure, so the pressure in the middle area of the upper surface of the fuel body 1 is lowered. This will cause the mist venting from the mist outlets 13 to have a tendency to move toward the middle area of the upper surface of the fuel body 1, i.e., move along and rise upwardly from the upper surface of the fuel body 1. The light emitted from the light source 4 is irradiated on the mist emerging from the mist outlets 13. The puffs of mist create various upward flame-like shapes are formed to simulate the state of real solid fuel flame combustion.

The above description is only preferred embodiments of the present invention. It should be noted that those skilled in the art may also make improvements and modifications without departing from the technical principles of the present invention, and such improvements and modifications should also be considered to be within the protection scope of the present invention.

What is claimed is:

1. A simulated solid fuel, comprising: a fuel body, a flow guiding device, a mist source and a light source, wherein the fuel body has a hollow structure inside, and is provided with a mist distribution chamber and an air directing chamber inside, the mist distribution chamber and the air directing chamber being isolated from each other inside the fuel body, mist outlets and mist inlets are respectively disposed on an outer surface of the fuel body, the mist outlets and the mist inlets all communicating with the mist distribution chamber, an upper surface of the fuel body is provided with an air ejection port, the air ejection port communicating with the air directing chamber; wherein the mist source is a device capable of generating mist, the mist source is provided with a mist delivery pipe connected to the mist inlets, and the mist source delivers the mist to the mist distribution chamber through the mist delivery pipe;

the flow guiding device is disposed inside or at the bottom of the air directing chamber such that air inside the air directing chamber forms an upwardly rising air flow; and light emitted from the light source is irradiated onto the mist venting from the mist outlets.

2. The simulated solid fuel according to claim 1, wherein the pressure of the mist delivered by the mist delivery pipe to the mist distribution chamber is higher than atmospheric pressure.

3. The simulated solid fuel according to claim 1, wherein the flow guiding device is a heat source disposed inside or at the bottom of the air directing chamber.

4. The simulated solid fuel according to claim 1, wherein the flow guiding device is an air blowing device disposed inside or at the bottom of the air directing chamber.

5. The simulated solid fuel according to claim 1, wherein the light source has a bar shape and is disposed on both sides of the fuel body, and the light emitted from the light source aims, at an angle, at a space above both the mist outlets and the upper surface of the fuel body.

6. The simulated solid fuel according to claim 1, wherein the mist source is generated by an atomizing ultrasonic mist generator.

7. The simulated solid fuel according to claim 1, wherein the mist inlets are disposed on an end surface or a bottom surface of the fuel body.

* * * * *